United States Patent [19]

Fischer, Jr.

[11] Patent Number: 4,884,775

[45] Date of Patent: Dec. 5, 1989

[54] ADJUSTABLE ROOF BRACKET

[76] Inventor: Karl W. Fischer, Jr., 7 Rutledge St., West Roxbury, Mass. 02132

[21] Appl. No.: 236,171

[22] Filed: Aug. 25, 1988

[51] Int. Cl.[4] ..... E04G 3/12

[52] U.S. Cl. ..... 248/237; 182/45; 248/242

[58] Field of Search ..... 248/237, 242; 182/45, 182/120, 121, 122

[56] References Cited

U.S. PATENT DOCUMENTS

| | | | |
|---|---|---|---|
| 348,705 | 9/1886 | Warren et al. | 248/237 |
| 955,159 | 4/1910 | Hillmon | 248/237 |
| 1,154,855 | 9/1915 | Gallup | 248/237 |
| 1,599,209 | 9/1926 | Cashman | 248/237 |
| 1,691,478 | 11/1928 | Henderson | 248/237 |
| 1,871,154 | 8/1932 | Burk | 248/237 |
| 2,320,538 | 6/1943 | Vogt | 182/45 |
| 2,496,556 | 2/1950 | Nelson | 182/45 X |
| 4,542,874 | 9/1985 | Ronning | 182/121 X |

FOREIGN PATENT DOCUMENTS

| | | | |
|---|---|---|---|
| 2292089 | 6/1976 | France | 182/45 |

*Primary Examiner*—David L. Talbott

[57] ABSTRACT

This application discloses an adjustable roof bracket whose bearing portion includes a lock portion having a series of aligned apertures. The bracket also includes a support portion pivotally mounted on the lock portion and having an engagement portion pivotally mounted on the support portion. The engagement portion has a hook portion adapted to engage in the apertures of the lock portion fixing the support portion in relation to the bearing portion and the roof upon which it is mounted.

3 Claims, 2 Drawing Sheets

ADJUSTABLE ROOF BRACKET

BACKGROUND OF THE INVENTION

Field of the Invention

This invention relates to adjustable roof brackets having means for adjusting the scaffold board support portion.

SUMMARY OF THE INVENTION

The invention disclosed herein comprises an adjustable roof bracket including a base portion, a board support portion and an adjustment portion. The base portion has a base, a first long side edge, and a lock portion, in right angle relation to the base. The base has a series of spaced, stops in right angle relation thereto, a series of spaced through, apertures, an end and a first plane. The apertures are spaced from the end, while the lock portion and stops extending toward the same plane. The board support portion includes first and second frame portions, the second frame portion having an edge from which the first frame portion extends in right angle relation thereto. The first frame portion has a first end and is in pivoting relation with the lock portion. The second frame portion has a free end includes a stop portion extending therefrom in right angle relation thereto. The adjustment portion has first and second terminal ends and a long side edge. The first and second terminal ends are in spaced parallel relation to each other and in right angle relation with the long side edge. A hook portion extends from the adjustment portion in close proximity to the second terminal end for engagement with the rectangular apertures in the base portion. The first terminal end is pivotally connected to the first frame portion whereby the base portion may be positioned on a support, the board support portion positioned in a predetermined angular relation to the base portion and the hook portion is engaged in one of the apertures of the lock portion and the second terminal end bears against one of the stops of the board support portion, fixing the board support portion in relation to the base portion and the support.

BRIEF DESCRIPTION OF THE DRAWINGS

Further details are explained below with the help of the example illustrated in the attached drawings in which.

DESCRIPTION OF THE PREFERRED EMBODIMENT(S)

Figure 1:
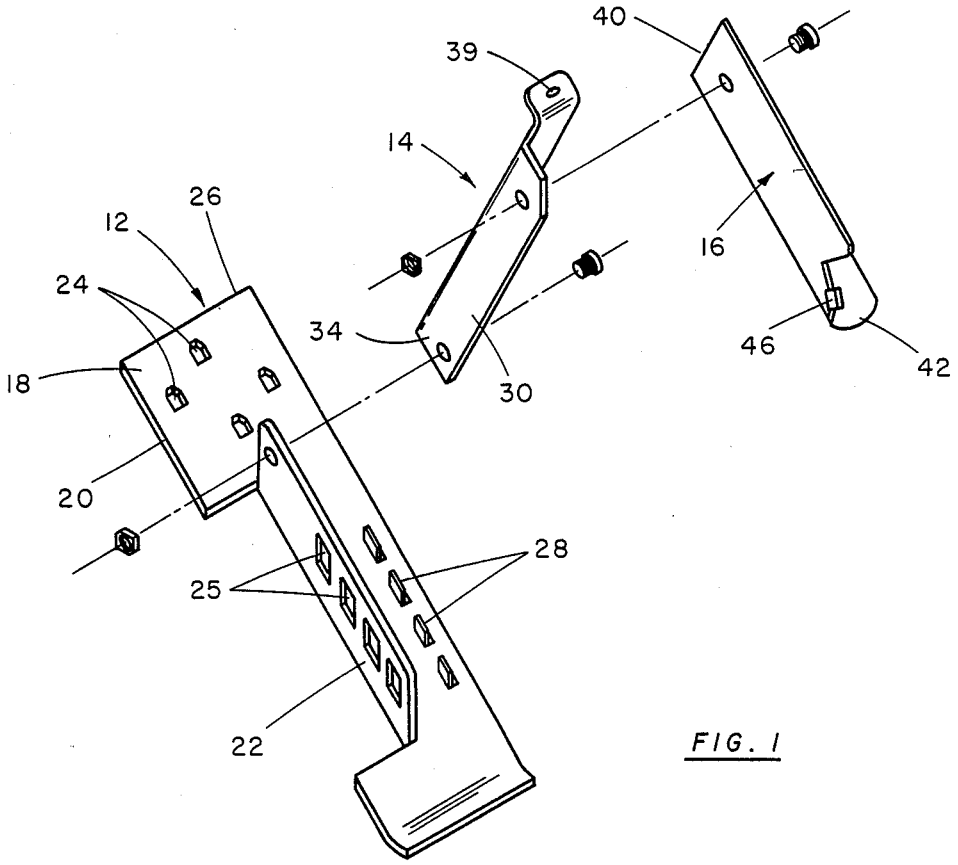
FIG. 1 is an exploded view of the adjustable roof bracket according to the present invention.

There is shown in the drawings an adjustable roof bracket 10 comprising a main base portion 12, a board support portion 14, and an adjustment portion 16.

The main base portion 12 has a generally, flat base 18, a first long side edge 20, a rectangular lock portion 22 formed from a portion of the the first long side edge 20 and bent into integral, right angle relation with the horizontal plane of the main base portion 12. A series of through apertures 24 formed through the base 18 of the main base portion 12 in close proximity to an end 26. The apertures 24 are spaced from each other and from the end 26. A series of stops 28 extend from the base 18.

Figure 2:
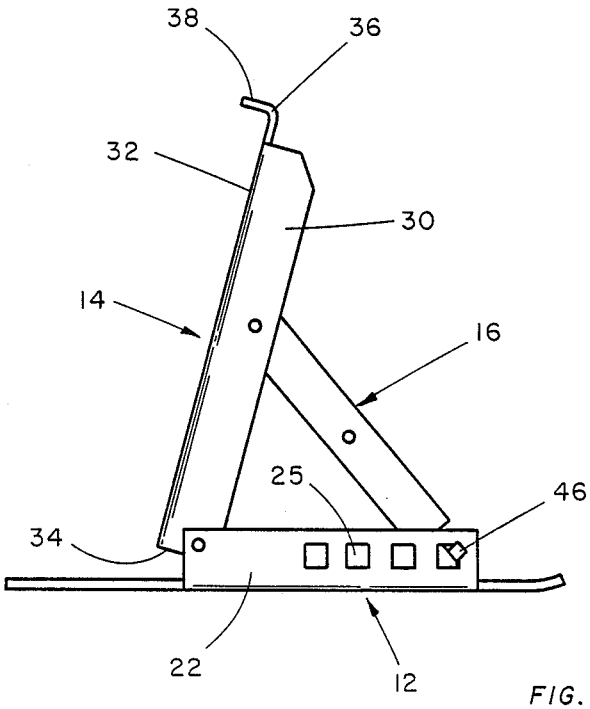
FIG. 2 is a side elevational view of the adjustable roof bracket shown in FIG. 1.
Figure 3:
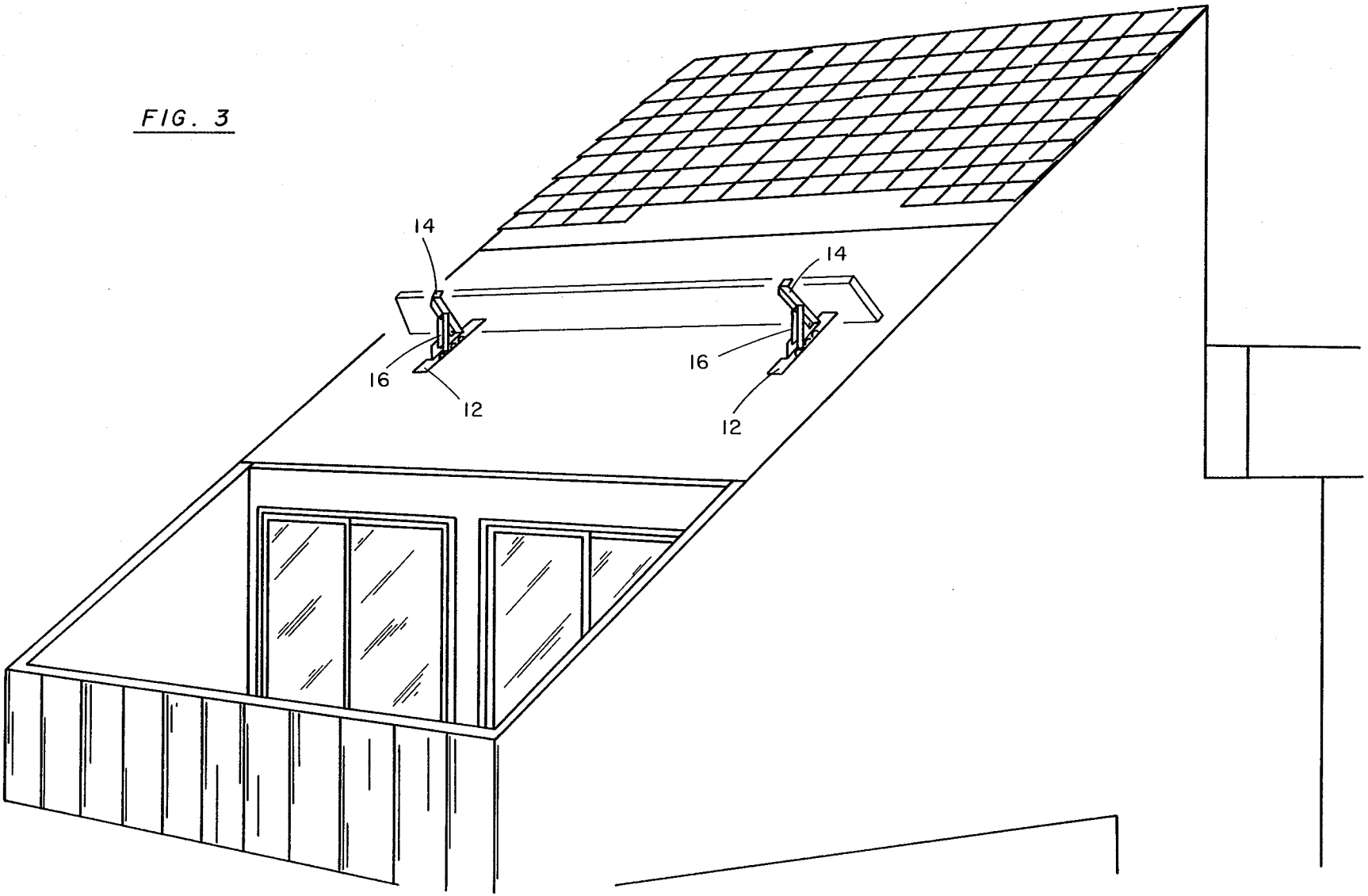
FIG. 3 is a perspective view of the adjustable roof bracket shown in FIG. 1 attached to a roof.

The stops 28 are longitudinally aligned, are in spaced parallel relation to the lock portion 22, extend toward the same plane as that toward which the lock portion 22 extends and are in spaced relation to each other. A series of through, rectangular holes 25 are formed in the lock portion 22 as shown in FIG. 2.

The board support portion 14 includes a first frame portion 30 and a second frame portion 32. The second frame portion 32 having a long edge from which the first frame portion 30 extends in integral, right angle relation thereto. The first frame portion 30 has a first end 34 and is in pivoted relation with the lock portion 22. The second frame portion 32 has a free end 36. A stop portion 38 extends in integral, right angle relation to the free end 36 and has a through nail hole 39. The nail hole 39 is used to secure the plank.

The adjustment portion 16 has a first terminal end 40, a second terminal end 42 and a long side edge 44. The first and second terminal ends 40, 42 are in spaced parallel relation to each other and in right angle relation to the long side edge 44. A hook portion 46 extends integrally from the adjustment portion 16 in close proximity to the second terminal end 42. The first terminal end 40 is pivotally connected to the first frame portion 30. The pivotal connection between the first terminal end 40 and the first frame portion 30 and the first end 34 of the board support portion 14 and the lock portion 22 are made by forming through holes in each of the parts and then using a rivet to complete the attachment.

Assume that work is to be done on a peaked roof, for example, a pair of adjustable roof bracket 10 are spaced from each other on the same line and the base portions 12 are nailed through the apertures 24, or the base 18 is otherwise fastened, to the slanted roof with the main base portion 12 abutting the slanted roof. The adjustment portion 16 is adjusted to position the second frame portion 32 as close as possible to right angle relationship with the roof on which the adjustable roof brackets 10 are fastened. The hook portion 46 is then engaged in the chosen rectangular hole 25 by flexing the adjuster 16 away from the plane of the board support portion 14 to beyond the plane of the lock portion 22 and then having the hook portion 46 snap into the rectangular hole 25. A plank or support element is then laid across the planar board support portion 14 permitting a workman, for example, to work on secure footing.

What I claim is:

1. An adjustable roof bracket comprising: a main base portion, a board support portion and an adjustment portion;

the main base portion including a base with a long side edge, a lock portion attached to the base along the long side edge and first and second ends, the lock portion extends from the base in right angle relation to the base and has a series of spaced through apertures, the base having a series of stops in right angle relation thereto near said second end, the stops being positioned longitudinally aligned and in spaced relation to each other and in spaced parallel relation to the lock portion, the lock portion and the stops extend toward the same plane;

the board support portion including first and second frame portions, the second portion having an edge from which the first portion extends in right angle relation thereto, the first frame portion having a first end which is connected in pivoting relation to the lock portion, the second frame portion having a free end opposite the first end of the first frame portion, the free end having a stop portion extending therefrom in right angle relation thereto;

the adjustment portion including a first terminal end, a second terminal end and a long side edge, the first and second terminal ends being in spaced parallel relation to each other and in right angle relation to with the long side edge, a hook portion extends from the adjustment portion in close proximity to the second terminal end, the first terminal end being pivotally connected to the first frame portion whereby the main base portion may be position on a support, the board portion is positioned in a predetermined angular relation to the main base portion, the hook portion engages one of the through apertures in the lock portion and the second terminal end bears against one of the stops of the main base portion, fixing the board support portion in relation to the main base portion and the support.

2. An adjustable roof bracket as setforth in claim 1 wherein the adjustment portion is related to the board support portion and the lock portion requiring the adjustment portion to be flexed away from the board support portion to engage the hook portion with the lock portion.

3. An adjustable roof bracket as setforth in claim 1 wherein the adjustment portion includes a base portion and a side, the side extending upward from the base portion, the hook portion integral with, extending and offset from the side, the hook portion having a shoulder and being positioned on the side whereby the shoulder extends through the aperture when the second terminal end bears against the stop.

* * * * *